United States Patent [19]

Tone et al.

[11] 4,042,395

[45] Aug. 16, 1977

[54] INTEGRAL FILM UNIT WITH INTERMEDIATE SHEET FORMING A FLUID RESERVOIR WITH ONE END PORTION THEREOF

[75] Inventors: Frederick F. Tone, Holley, N.Y.; Robert J. Borel, Columbus, Ohio

[73] Assignee: Eastman Kodak Company, Rochester, N.Y.

[21] Appl. No.: 572,541

[22] Filed: Apr. 28, 1975

Related U.S. Application Data

[63] Continuation-in-part of Ser. No. 570,898, April 23, 1975, abandoned.

[30] Foreign Application Priority Data

May 6, 1974 United Kingdom ..... 19880/74

[51] Int. Cl.[2] ..... G03C 1/48; G03D 9/02

[52] U.S. Cl. ..... 96/76 C; 354/304

[58] Field of Search ..... 96/76 C, 76 R, 200; 354/304, 305

[56] References Cited

U.S. PATENT DOCUMENTS

| | | | |
|---|---|---|---|
| 2,500,422 | 3/1950 | Land | 96/76 R |
| 3,689,269 | 9/1972 | Schieven | 96/76 C |
| 3,764,332 | 10/1973 | Harvey | 96/76 C |
| 3,775,127 | 11/1973 | Nerwin | 96/76 C |

*Primary Examiner*—David Klein

*Assistant Examiner*—Richard L. Schilling

*Attorney, Agent, or Firm*—J. A. Matthews

[57] ABSTRACT

A photographic film unit with lateral and transverse edges having a pair of sheets connected in superposition with a photosensitive layer located between the sheets. A container carrying a quantity of fluent processing composition is arranged to provide for the discharge of the composition to between the sheets. The improvement comprises an integral intermediate sheet disposed between the pair of sheets and coupled to both of them at the lateral marginal portions thereof and separating such lateral marginal portions of the sheets by a predetermined amount. A portion of the intermediate sheet extends from between the pair of sheets at one end thereof and is secured transversely to one of the sheets at that end and is folded away from that sheet over itself within the compass of that sheet to define a compartment for fluent processing composition. The intermediate sheet has a centrally disposed exposure aperture and lateral edges which are in register with the lateral edges of the other sheets. The outer portions of the lateral edges of the intermediate sheet have a greater thickness than does the boundary of the aperture. The differing thicknesses of the intermediate sheet may be formed by machining a portion of the sheet which is originally of the thickness of the lateral edges, or by the utilization of separate spacer rails at the lateral edges.

24 Claims, 9 Drawing Figures

INTEGRAL FILM UNIT WITH INTERMEDIATE SHEET FORMING A FLUID RESERVOIR WITH ONE END PORTION THEREOF

RELATED APPLICATIONS

This application is a continuation-in-part of U.S. Ser. No. 570,898, now abandoned, filed on Apr. 23, 1975, in the names of Frederick F. Tone and Rober J. Borel, and entitled INTEGRAL FILM UNIT.

BACKGROUND OF THE INVENTION

Self-processing photographic film units are now available which are completely self-contained and are adapted to be employed in a camera in which the film unit is exposed and then processed by moving it between a pair of pressure-applying members. The components of the film unit are assembled to form an integral structure and the integrity of this structure is maintained during exposure, processing and viewing, thereby making it unnecessary to store, handle and/or move separately, individual elements of the film unit, and minimizing the complexity of the structure required to contain and manipulate the film unit to effect exposure and processing thereof. Such a film unit structure is attractive, includes a minimum of simple and easily assembled components, is of a minimum size in relation to image size and generally includes substantially no excess materials. The film unit includes a container of the processing fluid and means for promoting and facilitating spreading of the fluid in a layer of predetermined depth and extent.

Such film units generally comprise two separate, flexible sheetlike elements including a first or image-recording sheet including a layer containing a photosensitive image-recording material and a second sheet for aiding in the distribution of a viscous liquid processing agent as a layer in contact with an exposed area of the photosensitive material. The supports of the sheets are both transparent to provide for exposure of the photosensitive material through the second sheet support while the sheets are in superposition, and to provide for viewing the image formed through the first sheet support. The two sheets are secured to one another at their lateral margins to form an integral unit, the integrity of which is established prior to loading into a camera, is maintained throughout exposure and processing and can be maintained subsequent to processing.

The film unit further includes a rupturable container filled with a fluent processing composition, the container being conveniently formed from a rectangular blank of a multilayer, fluid impermeable sheet material folded medially upon itself to form two walls sealed to one another along three sides to form an elongated cavity, or a plurality of cavities, filled with the fluent processing composition or liquid. The container usually includes elongated transverse marginal sections and end marginal sections, the seal between the transverse marginal sections being weaker than the seal between the end marginal sections so as to become unsealed and form one or more fluid discharge passages in response to pressure generated within the fluid contents of the container as a result of the application of compressive pressure to the walls of the container. The fluid-filled cavity is formed by medial sections of the container walls that are bellied outwardly so that when the container is flattened by progressively applying compressive pressure its fluid contents are ejected. As the viscous fluent processing composition is discharged from the container, it is spread from the leading end of the film unit between the sheets toward the trailing end thereof to form a substantialy uniform layer between the sheets. Excess processing fluid is then trapped and retained within the film unit at the trailing end thereof. The processing fluid includes, in addition to the reagents required to produce a diffusion transfer image, a thickening or film-forming agent provided to aid in the formation of a layer or film of the fluid between sheets, and an opacifying agent.

In prior art film units of the general type described above, various means have been provided for holding the two sheets together. Such joining means generally comprise an element which couples the sheets of the film units together. Examples of such coupling elements are illustrated in U.S. Pat. Nos. 3,748,139, 3,764,332, 3,775,127 and 2,500,422. The joining means disclosed in the first two references included a masking element which is coupled to the inner surface of the periphery of the two superposed sheets by layers of adhesive. This masking element has a substantially uniform thickness which necessitates the use of recessed or stepped pressure members to achieve the desired processing fluid thickness. Moreover, to avoid undesirable effects along the periphery of the image area it is necessary to regulate the thickness of the processing fluid at the periphery of the image area within very close tolerances. One method of preventing such edge defects from detracting from the photographic image is disclosed in U.S. Pat. No. 3,775,127, wherein a very thin mask coating is applied to one of the sheets to form the periphery of the visible image with the lateral edges of the sheets being adhesively coupled substantially directly together by narrower strips of adhesive along the outer lateral edges. This construction also required the use of recessed or stepped pressure members or rollers.

Other prior art constructions have utilized a thin mask in conjunction with separately applied spacer members along the lateral edges of the film unit to hold the sheets together. Such constructions have overcome the problem of edge defects appearing around the visible image since the processing fluid extends behind the mask to the thicker spacer members, but have been generally more difficult to assemble in view of the close tolerances necessary in applying the spacer members accurately in registration with the mask. Moreover, it is difficult to automatically and mechanically handle such small thin, separate spacer members.

Another approach to joining the two sheets is illustrated in U.S. Pat. No. 2,500,422, wherein an external binder element is employed which is wrapped around all four edges of the two sheets and is secured to the outer surfaces of the sheets to maintain them in registration. Such a construction solves some of the problems of edge defects since it is possible for the processing fluid to spread behind the inner periphery of the binder element so that any edge defects occur between the wrapped-around portions of the binder element. However, such a construction has the disadvantage that the choice of the material and the color of the binder element is limited to that which is acceptable at the viewing face of the picture unit since a portion of the binder element frames the viewing surface of the picture. Also, the use of such a binding element provides a viewing surface which is not planar and which has a portion that can become frayed and unsightly with handling. Moreover, the use of such external binding elements can, in some instances, necessitate the embossing of one or both of the sheets to provide satisfactory spreading of the processing fluid. More significantly, the use of such external binders complicates the assembly of such film units in that it is not possible to assemble the film units by joining substantially continuous webs of the two sheet materials to the binder element and subsequently chopping individual film units from the composite web. While it is relatively simple to provide a binder which is wrapped around the portion of the picture units which form the edges of the continuous composite webs, it is not possible to provide a binder which is wrapped around the edges of adjacent film units which are formed as they are chopped from a continuous web, i.e., the edges which are transverse of the web. It is necessary to space on the binder web the sheets forming one film unit from the sheets forming the next adjacent film unit to provide the necessary length of binder therebetween which can be cut and then wrapped around the adjacent edges of each of the finished film units after the continuous web has been chopped into individual film units. Accordingly, it is necessary to utilize a less efficient method of assembling such film units utilizing a continuous web of the binder element material, and disposing discrete sections of superposed sheets at spaced locations on the web, which superposed sheets must be accurately positioned with regard to the binder web and must be maintained in superposition and alignment with respect to each other while the various assembly operations are performed. This, of course, complicates and increases the cost of such film unit fabrication.

SUMMARY OF THE PRESENT INVENTION

In accordance with one embodiment of the present invention, a film unit construction includes a unitary intermediate sheet which is disposed between and couples two sheets together. The intermediate sheet has a thin mask portion surrounding the periphery of the photographic image and thicker spacer rail portions along the lateral edge portions of the film unit which provide the necessary spacing between the sheets for the required control of the processing fluid spread. Such a construction significantly simplifies the manufacture of film units since the film unit may be fabricated from three substantially continuous web elements which may be joined while in web form, and are chopped into individual film units only after complete assembly. Moreover, the present intermediate sheet provides, within a single element, pod and trap covers without requiring additional elements that must be handled and connected within close dimensional tolerances. Still further, the present invention provides a film unit which has a substantially planar viewing surface with no distracting external borders that might invite removal and subsequent disassembly of the film assembly. Still further, the present invention provides a film assembly in which the intermediate sheet may be formed from a material having color and/or other characteristics necessitated by its function as a mask and coupling element alone without detracting from the appearance of the photographic image by a portion which appears on the image-viewing side of the film unit.

Thus, this embodiment provides a photographic film unit having lateral and transverse edges comprising a first sheet having thereon a layer of photosensitive material capable of recording an image when exposed to actinic radiation and a second sheet arranged in superposition with the first sheet with the photosensitive layer located between the sheets. A container carrying a quantity of a fluent processing composition and having a discharge passage adapted to be opened in response to generation of pressure within the composition is arranged to discharge the composition to between the sheets. An intermediate sheet is disposed between the first and second sheets and is coupled to both of them at the lateral marginal portions thereof. The intermediate sheet separates the lateral marginal portions of the first and second sheets by a predetermined amount and has an end portion which extends from between the sheets at one end thereof and is folded around that end of one of the first and second sheets to overlie the outside surface thereof. This end portion of the intermediate sheet is coupled to the outside surface of that sheet to form a fluid trap.

Further, this embodiment provides a film unit comprising a photosensitive sheet and second sheet permanently secured together in superimposed relationship. Spacer means is provided between the sheets and peripherally spaces the sheets permanently securing the sheets together along opposed lateral edges thereof. The spacer means extends from between the sheets at one end and is secured transversely to one of the sheets adjacent that end. The spacer means is folded away from the one sheet over itself within the compass of that sheet at the one end and is secured in the folded state to define a compartment for fluent processing composition.

Still further, this embodiment provides a film unit wherein an integral intermediate sheet is disposed between the sheets and is coupled to both of them at the lateral marginal portions thereof for separating the lateral marginal portions of the sheets by a predetermined amount. The intermediate sheet has a centrally disposed aperture and lateral edges which are substantially in register with the lateral edges of the other sheets. The outer portions of the lateral edges of the intermediate sheet have a greater thickness than does the boundary of the aperture.

The various features of novelty which characterize the present invention are pointed out with particularity in the claims annexed hereto and forming part of this specification. For a better understanding of the invention, its operating advantages and the specific objects obtained by its use, reference should be had to the accompanying drawings and descriptive matter in which a preferred embodiment of the present invention is illustrated and described. While the relative dimensions and thicknesses set forth in the preferred embodiment have been found to give operable results, they are presented not in a limiting, but in an illustrative sense.

PREFERRED EMBODIMENT

Figure 1:
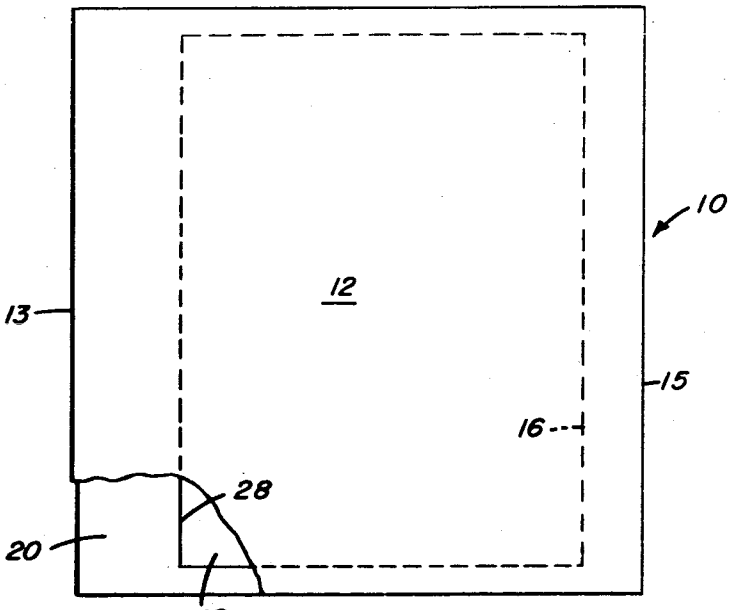
FIG. 1 is a front view of a film unit incorporating a preferred embodiment of the present invention, with a portion removed to show a portion of the inner construction.

FIG. 1 illustrates a film unit 10 incorporating a preferred embodiment of the present invention. The film unit has lateral and transverse edges and comprises a first sheet 12 which is provided on its inner surface with one or more photographic layers as disclosed, for example, in copending U.S. Pat. applications Ser. No. 308,869, filed Nov. 22, 1972, and now U.S. Pat. No. 3,880,658, in the names of Lestina et al issued as United States Patent No. 3,880,658 on Apr. 29, 1975 and 351,673, filed Apr. 16, 1973 in the name of Fleckenstein et al; and Canadian Pat. No. 928,559. As the film unit is processed it is transported between a pair of pressure applying members with the transverse edge 13, adjacent the fluent processing-composition-containing container or pod 14, first. This transverse edge 13 is hereinafter referred to as the "leading" edge or end while the opposite transverse edge is called the "trailing" edge or end 15 of the film unit. Preferably, the layer which is visible through the support of sheet 12 is initially white so that the minimum density areas of the visible image formed will be white. This also assures that the image borders, which are protected from exposure and processing by the masking portion of the present invention, as will be more thoroughly described hereinbelow, will also be white. As shown, the first sheet 12 is substantially planar and has a substantially planar outer surface that forms the entire front, viewing surface of the film unit. In the film unit illustrated, the visible image occupies the area indicated by the dotted rectangle 16. In FIG. 1, a corner of the first sheet 12 is broken away at the leading edge 13 to show a portion of the other elements of the film unit.

Figure 2:
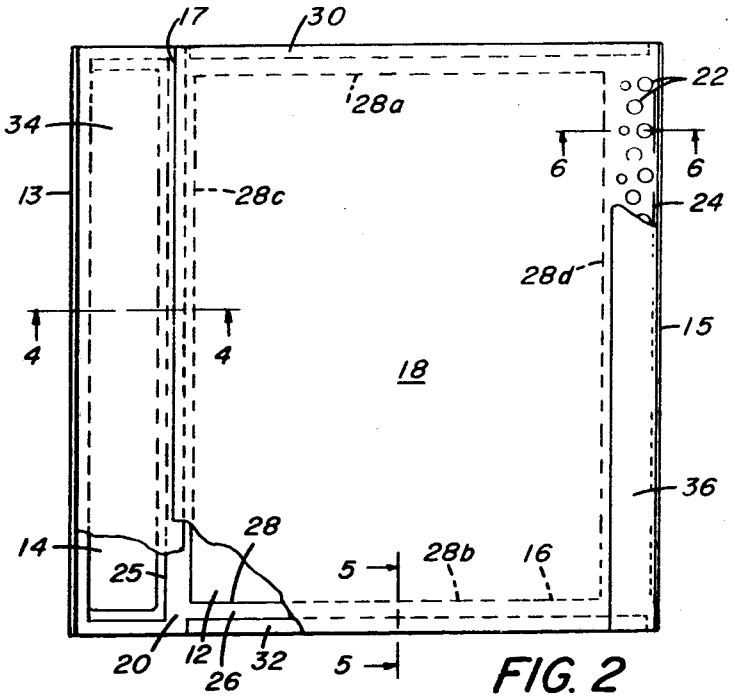
FIG. 2 is a rear view of the film unit illustrated in FIG. 1, with portions removed.
Figure 3:
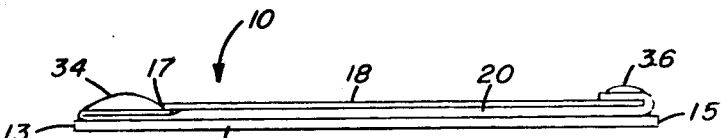
FIG. 3 is an edge view of the film unit illustrated in FIG. 1.
Figure 4:
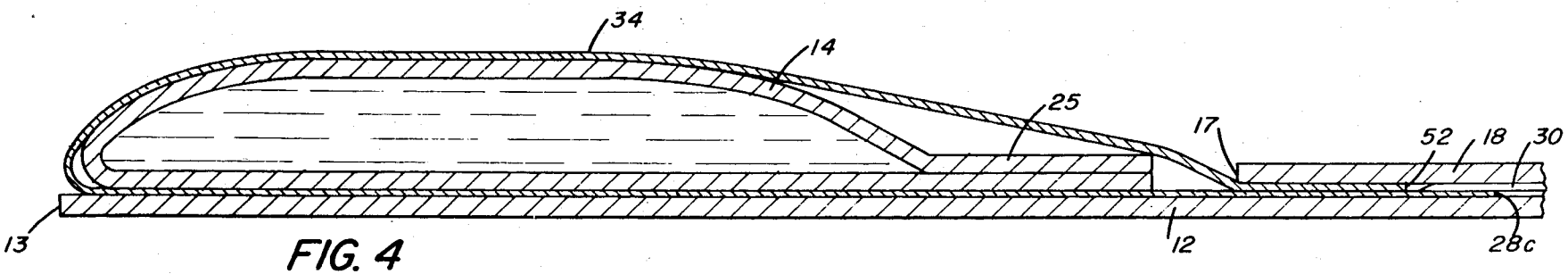
FIG. 4 is a partial cross section taken along line 4—4 of FIG. 2.
Figure 5:
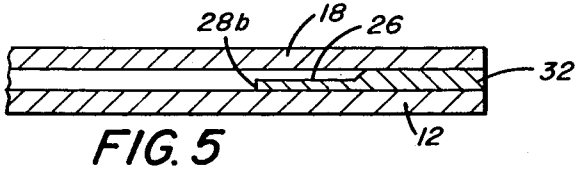
FIG. 5 is a partial cross section taken along line 5—5 of FIG. 2.
Figure 6:
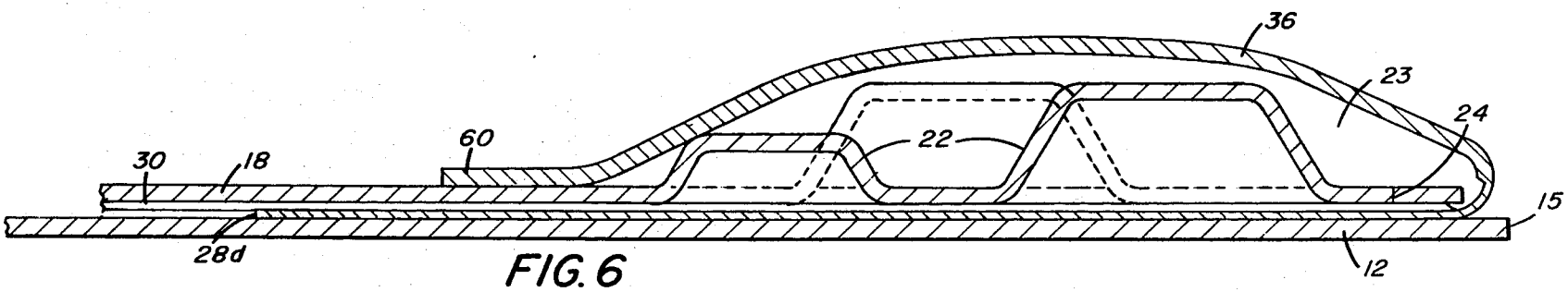
FIG. 6 is a partial cross section taken along line 6—6 of FIG. 2.

A second sheet 18, provided on its inner surface with suitable timing and neutralizing layers, is arranged in superposition with the first sheet 12 and is connected thereto by means of an intermediate sheet 20. Preferably, the supports of the sheets 12 and 18 are transparent to actinic radiation, as are the layers provided on sheet 18 whereby, in the preferred embodiment, the film unit may be exposed from the side corresponding to sheet 18 (illustrated in FIG. 2) and the developed image viewed from the opposite side, corresponding to sheet 12 (illustrated in FIG. 1). As shown in FIGS. 2, 3 and 4, the second sheet 18 is substantially the same width as the first sheet 12, but is shorter. The difference in length between the first and second sheets 12 and 18 is just slightly greater than the narrow dimension of the fluid container or pod 14, i.e., the dimension of the pod from the leading end toward the trailing end of the film unit. The first and second sheets are superposed with the leading end 17 of the sheet 18 terminating short of the corresponding end of sheet 12. The pod 14 is disposed on the extending portion of sheet 12 between the leading edge of sheet 12 and the leading edge 17 of sheet 18. The trailing end portion of the second sheet is provided with a plurality of "dimples" 22 which are embossed from the outer surface of that sheet to form a plurality of cavities on the inner surface thereof and a plurality of corresponding protrusions on the outer surface. These "dimples" are arranged to space apart the pressure-applying members or rollers of a processing camera to assist in forming a trap or trapping volume or space 23 which receives and accommodates excess processing composition after it has been spread the length of the film unit. A plurality of slits or perforations 24 are provided through the second sheet, between the trailing end and the dimples, which act as valves that permit the excess processing composition forced to the trailing end of the film unit between the sheets to pass through the second sheet into the trapping space around the dimples between the outer surface of the second sheet and a trap cover 36. A more complete description of the trap is provided hereinafter.

Container 14 may be of a type known in the art. As described above, it carries a quantity of a viscous fluent processing composition which contain agents capable of reacting with portions of the photographic layers following exposure to produce a visible image. The container 14 has one or more cavities and has a lateral dimension slightly less than the width of the film unit. The transverse marginal edge 25 of the pod is formed as a burst seal which is arranged to open to form one or more discharge passages in response to pressure generated within the composition within the container, generally as a result of the application of compressive pressure to the external walls of the container by a pair of pressure members, such as superposed rollers, in a processing camera. Upon opening of the burst seal, or seals, the processing composition is discharged to between sheets 12 and 18 for spreading therebetween in a manner well known in the art.

The intermediate sheet 20 is a unitary, multifunction sheet member which extends between the first and second sheets and couples them together, provides a mask portion 26 which surrounds and forms an exposure aperture 28, which is excised from the intermediate sheet, and subsequently forms the periphery 16 of the visible image, provides the spacer rail portions 30 and 32, that give the requisite spacing between sheets 12 and 18 to furnish the necessary thickness of the processing composition which results in the desired photographic processing, and provides a pod-attaching cover 34 at one end and the trap cover 36 at the other end of the film unit. The intermediate sheet is a multi-thickness element, preferably formed from a single sheet of material in a manner to be described more thoroughly hereinafter. The major portion of the intermediate sheet, including the mask portion 26 and the pod cover 34 is of a first thickness. In the preferred embodiment, the spacer rail portions 30 and 32 and the trap cover portion 36 of the intermediate sheet have a thickness generally twice that of the first thickness.

The generally centrally disposed mask portion 26 of the intermediate sheet 20 is provided with an aperture 28 which corresponds to, and actually forms the periphery 16 of the visible image. At least the mask portion 26 and preferably the entire intermediate sheet is opaque to the actinic radiation that expose the photosensitive layers on the first sheet. This opacity may be provided either with opacifying agents in the intermediate sheet itself or by coating one or more surfaces, or portions thereof, of the intermediate sheet with an opaque layer. The lateral edges **28*a* and 28*b* of this aperture are spaced inwardly from both lateral edges of the film unit by a pre-determined, relatively narrow distance. This distance corresponds to the lateral borders provided for the visible photographic image. The leading transverse edge 28***c* of the aperture is spaced from the leading edge 13 of the picture unit by a distance greater than the narrow dimension of the pod 14, substantially as illustrated in FIGS. 2 and 4. The trailing transverse edge 28*d* of the aperture is spaced from the trailing edge of the film unit by a distance slightly greater than the width of the trap 23. In the preferred embodiment illustrated, for example, the width of the trap is approximately twice the width of the lateral borders of the visible image and about one-half the width of the transverse border at the leading edge of the film unit. The periphery of the mask portion 26 around aperture 28 is sealed to the inner surface of the first sheet 12 to prevent contact of the photographic layers on sheet 12 by the processing composition, except within the aperture area. Preferably the remainder of the intermediate sheet 20 in contact with the inner surface of the first sheet 12 is also sealed thereto to provide a substantially unitary assembly. Thus the mask portion prevents both the exposure of the image borders to the actinic radiation and to contact with the processing composition thereby assuring that the borders remain white.

The spacer rail portions 30 and 32 of the intermediate sheet 20 have outer edges in registry with the lateral edges of the film unit. The spacer rail portions extend along the lateral edges of the film unit from just ahead of the leading edge 28*c* of the aperture to almost the trailing end of the first sheet 12. As illustrated, the width of the spacer rail portions is approximately one-half the width of the lateral borders of the visible image. The spacer rail portions of the intermediate sheet are secured to the inner surface of the second sheet 18 along the lateral edge marginal portions of the film unit, thereby spacing the inner surface of the second sheet from the inner surface of the first sheet by a distance substantially equal to the thickness of the spacer rail portions, and coupling the second sheet to the first sheet to form a unitary film unit structure. Thus, the spacer rail portions also determine the thickness of the processing composition as it is spread through the film unit.

Figure 7:
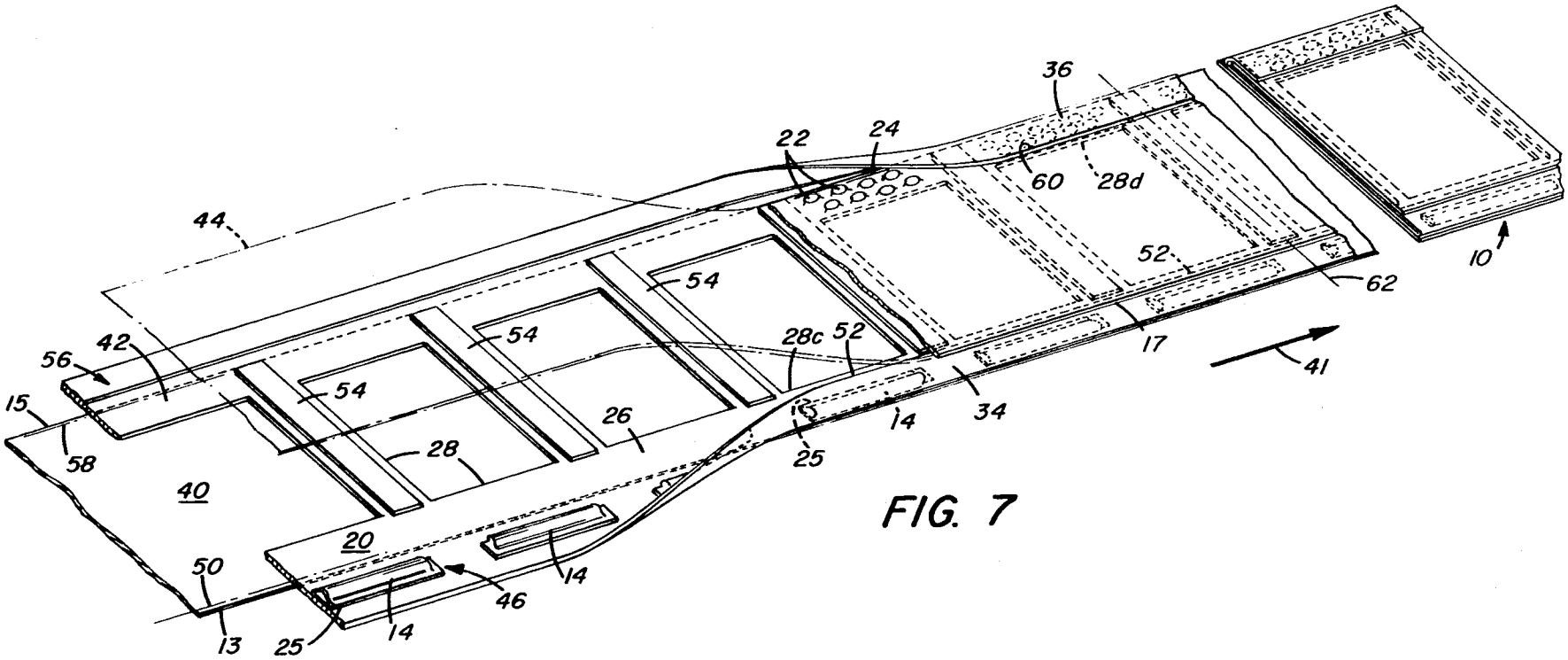
FIG. 7 is a perspective view showing one method of assembling a film unit embodying the present invention.

As illustrated in FIG. 7, the first, intermediate and second sheets are supplied to the assembly apparatus in the form of substantially continuous webs 40, 42 and 44, respectively. Because of the unique qualities of the intermediate sheet 20, and the fact that it is disposed between sheets 12 and 18, it is possible to accomplish all of the assembly operations on the film units while they are still in a continuous web form, with the transverse chopping of the assembled, individual film units from the composite web being the last assembly operation prior to inspection and insertion into a cartridge.

As may also be seen in FIG. 7, the web 40 of the first sheet material, and web 42 of the intermediate sheet material are fed substantially continuously through the assembly apparatus in the direction indicated by arrow 41. Webs 40 and 42 are aligned laterally and are sealed together, with care being taken to assure the complete seal of the periphery of the mask portion 26 about the aperture 28 to the surface of web 40. The edge portion 46 of the web 42, which forms the intermediate sheet 20, that subsequently forms the pod or container cover 34 is initially substantially planar with the remainder of the intermediate sheet and extends beyond the leading edge 13 of the web 40 forming the first sheet 12. Prior to the mating of webs 40 and 42, the pods 14 have been secured or sealed to the extending pod-cover portion 46 of the intermediate sheet with the marginal edge of the pod forming the burst seal 25 directed away from the edge of web 40 which forms the leading edge 13 of the first sheet. After the webs have been sealed together the pod cover 34, carrying the pod 14, is then folded along dotted line 50, just inside the leading edge 13 of the first sheet web 40, until the pod 14 overlies and is supported by that portion of the intermediate sheet on the first sheet between the leading edge of the first sheet and the leading edge of the aperture 28*c*. The edge 52 of the pod cover 34 extends beyond the burst seal 25 of the pod and overlies the masks portion 26 of the intermediate sheet which forms the leading transverse edge 28*c* of the exposure aperture. Care is taken to assure that the edge 52 of the pod cover is spaced from the leading edge 28*c* of the aperture, substantially as illustrated in FIG. 4. After the pod cover, and the pod carried thereby, has been folded, seals are made between the pod cover and the underlying mask portion of the intermediate sheet along the portions of the web which will form the lateral edges of the film unit, beyond the ends of the pod, to hold the pod and the pod cover in position. Care is taken to assure that these seals do not extend transversely of the picture unit across any portion of the burst seal of the pod.

The web 44, from which the second sheet 18 is formed, is embossed along one edge to form the dimples 22 which create the trapping space at the trailing end of the film unit, and perforated at that edge to form the "valves" 24 that admit the excess processing composition into the trapping volume on the outer surface of sheet 16. The web 44 of the second sheet material is then superposed with the intermediate sheet and is sealed to the upper surfaces of the raised portions 54 which become the spacer rail portions 30 and 32 when the web is chopped into individual film units. Simultaneously, or after the formation of the seals between the second sheet and the spacer rail portions, a seal is made transversely of the film unit between the end marginal portion of web 44 forming the leading end 17 of the second sheet and the marginal portion of the pod cover adjacent edge 52, i.e., in the region between edges 17 and 52, as shown in FIG. 4. Again, care is taken to assure that this sealing operation does not affect the burst seal of the pod.

The edge portion 56 of the web 42, which forms the trailing end of the intermediate sheet 20, initially also extends beyond the edge of web 40, which forms the trailing end 15 of the first sheet, and is arranged, after web 44 is connected to the intermediate-sheet-forming web 42, to be folded along line 58 around the "trailing" edge of web 44 over the dimples 22 to a position between the leading edge of the dimples and the trailing edge 28*d* of the aperture to form a trap cover 36 which is sealed to the outer surface of the second sheet along the leading marginal portion 60 of the trap cover.

The composite web is then advanced to a chopping station where it is cut transversely, substantially along the center of raised portions 54 as indicated by line 62, thereby forming individual film units 10. The film units are then inspected and loaded into the appropriate containers or cartons. It will be appreciated that the assembly of the various webs 40, 42 and 44 illustrated in FIG. 7 has been longitudinally compressed for simplification of illustration and that, due to the time requirements for various seals and the necessity of lateral web aligning operations, the actual assembly of the film unit requires longer distances than those illustrated.

In the preferred embodiment the intermdiate sheet 20 is formed from a web 42 of a polymeric material, such as polyester, which has been formed with the two thicknesses necessary for the mask and pod cover portions as well as for the spacer rail and trap cover portions, as previously described. The material is either inherently opaque or is provided with an opaque coating. Such an opaque coating may be applied before or after the grinding operation described below. One method of manufacturing such a dual thickness web is to commence with a polymeric web having a thickness substantially equal to the thickness of the trap cover and spacer rail portions, which in the preferred embodiment are approximately three mils thick. The web is then passed through grinding or skiving apparatus wherein portions are machined away, in a manner well known in the art to form the thinner sections. In the preferred embodiment, the pod cover and mask portions are ground to a thickness substantially one-half that of the trap cover and spacer rail portions.

The web 42 is provided with the necessary adhesive coatings before being supplied to the film unit assembly machine. With the intermediate sheet construction of the present invention, all adhesive coatings may be placed on the intermediate sheet before it is introduced to the film unit assembly machine. Similarly, the aperture 28 may be formed in the intermediate web prior to introduction to the assembly machine, or, alternatively, the aperture may be formed in the web after it has been introduced into the assembly machine. Inasmuch as the intermediate sheet web 42 carries all of the spacing elements of the film unit and all of the adhesive coatings necessary, it is the only pitched web utilized in the construction of the film unit so that it is not necessary to axially align two or more pitched webs, thus significantly simplifying the assembly procedure and permitting the maintenance of significantly closer dimensional tolerances. This is particularly true since the web 44 forming the second sheet may be embossed to form the dimples 22 forming the trap spacer just before the web is assembled into the film unit construction. Moreover, it will be appreciated that with the present invention, dimensional tolerance accumulations are minimized since several elements of the final film unit are formed from a single, integral element. Still further, the intermediate sheet web may be used as a carrier web for the assembly of the film units whereby various operations are controlled by the use of registration marks placed on an exposed portion of the intermediate sheet. As noted above, since the first and second webs need not be pitched, the longitudinal registration of these webs with the intermediate sheet is not critical, as would be the case if it were necessary to longitudinally register them in a predetermined relationship with respect to the intermediate sheet.

Still further, the present invention provides additional advantages in the manner in which the film unit is sealed together. Inasmuch as the mask portion of the intermediate sheet is relatively thin, it is possible to seal the periphery of the mask to the first sheet at relatively high speeds utilizing relatively lower temperatures than would otherwise be necessary were the mask portion thicker. This is particularly advantageous in preventing damage to the emulsion layers on the inner surface of the first sheet which can be damaged by extended exposure to elevated temperatures. Moreover, the present invention facilitates the sealing of the trap cover, in the region of marginal portion 60, to the outer surface of the second sheet because the extra thickness of the trap cover in that region compensates for the fact that the second sheet is relatively unsupported in that region by the intermediate sheet, at least for the thickness of the spacer rail portion.

Moreover, the use of a thinner pod cover portion permits the end 52 thereof to be disposed between the first and second sheets without increasing the total thickness of the film unit in that region since the combined thickness of the two layers of the intermediate sheet at that point is substantially equal to the thickness of the side rail portions.

While the preferred construction of the intermediate sheet utilizes a polymeric material, it is also possible to form the intermediate sheet from a paper-like material such as used for computer punch cards, or a paper impregnated with a suitable substance. Similarly, a laminate of paper and polymeric material may also be employed. With both of these alternate materials it is possible to form the multi-thickness structure by skiving or grinding, as disclosed above. These materials also have the opacity mentioned above. The intermediate sheet can be satisfactorily formed from a sheet of material with a first uniform thickness, substantially equal to that of the mask portion, onto which the spacer rail portions are formed by depositing, such as by printing or adhering an additional layer or layers of a compatible material so as to form the desired thickness of the spacer rail portions. Still further, despite the difficulty in handling separate spacer rails noted above, it has been found possible to do so and they may be applied to either the web which forms the intermediate sheet or to the web which forms the second sheet before these webs are mated and sealed together.

Thus, the present embodiment provides an unexposed, unprocessed film unit comprising a photosensitive sheet and a second sheet permanently secured together in superimposed relationship by an intermediate sheet extending along and between opposed lateral edges of the sheets. The intermediate sheet extends from between the sheets at one end thereof and is secured transversely to one of the sheets adjacent that end. The intermediate sheet is folded away from the one sheet upon itself within the compass of that sheet at the one end and is secured in the folded state to define a compartment for fluent processing composition, i.e. either or both of the pod and the trap.

As previously, noted, the present embodiment provides a trap cover 36 which has a thickness substantially equal to the thickness of the spacer rail portion thereby providing additional protection against the escape of fluid in the trap after processing of the film unit. The present trap construction provides a compartment for accepting the excess fluent processing composition that incorporates many advantages. Specifically, the utilization of dimples 22 embosed in the second sheet to provide the necessary spacing of the pressure members as the trap passes therebetween eliminates the need for an additional spacer element which would complicate and make more expensive the fabrication of the film unit. Moreover, the perforations or slits 24, which may either be straight, as shown, or arcute, make it possible to substantially isolate the excess processing composition contained within the trap form the image area. This isolation occurs because the slits tend to only open under pressure in the composition generated by the pressure members, which pressure cannot be obtained by manipulation of the film unit after processing. Thus, the excess processing material is unlikely to be forced back into the image area after processing, thereby preventing the undesirable effects possible therefrom.

Further, the present trap construction provides the necessary trapping volume on the back surface of the film unit without requiring a significant increase in film unit size since the excess processing composition is caused to reverse directions, as it flows, through the slits 24, toward the leading end of the film unit on the outside of the second sheet. Provision is also made in the trap cover of the present arrangement to permit the escape of air therefrom in a manner disclosed in U.S. Pat. No. 2,500,422. This air release provision may include portions which are left unsealed in the leading edge of the trap cover, or may be small perforations through the cover which permit the escape of air but prevent the escape of the processing composition. Alternatively, the leading edge 60 of the trap cover may be skived to a thinner thickness in selected small regions of the inner surface, thereby providing escape passages for the release of air.

Still further, it will be seen that the pod cover 34 of the present invention provides an extra protective cover for the pod 14 to decrease the possibility of rupture of the pod material permitting the escape of the processing composition. Moreover, since the pod cover is formed of the thinner portion of the intermediate sheet, the overall thickness of the film unit at the pod end is not significantly increased. This permits the stack height of a number of film units within a cartridge to be minimized, and also facilitates the introduction of the leading end of the film unit into the nip of the pressure members of a processing camera.

It should be noted that fold lines 50 and 58 (FIG. 7), about which the pod and trap covers are folded, respectively, are inside the edges 13 and 15 of the first sheet-forming-web 40 so that when the exposed, processed film unit is viewed from the viewing surface, no portion of the intermediate sheet or the second sheet is visible therefrom. In other words, the visible perimeter of the film unit, when viewed from the viewing surface (i.e., FIG. 1), is determined by the perimeter of the first sheet. As a result, it is unnecessary to limit the selection of the material forming the intermediate sheet to those which are compatible, visibly, physically, and otherwise, with the image-viewing surface of the film unit, thus permitting the selection of an intermediate sheet material according to characteristics which best provide the features thereof noted above.

ALTERNATE EMBODIMENTS

Figure 8:
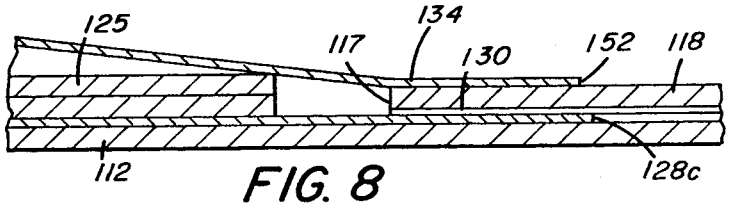
FIG. 8 is a partial cross section corresponding to FIG. 4 of an alternate embodiment of the present invention.

An alternate embodiment of the present invention is illustrated in FIG. 8 wherein an alternate connection between the pod cover 134 and the leading end 117 of the second sheet 118 is illustrated. Other components of the alternate embodiment are given the same reference numerals as the similar components in the preferred embodiment with the prefix "1". In this embodiment, the pod cover is sealed to the outside surface of the second sheet, in which case the manufacturing procedure described above is modified so that the pod cover is not folded until after the second sheet has been supplied to the assembly.

Figure 9:
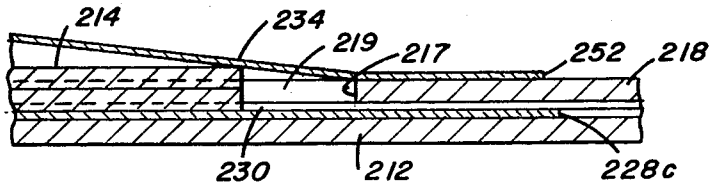
FIG. 9 is a partial cross section corresponding to FIG. 4 of a second alternate embodiment of the present invention.

A second alternate embodiment is illustrated in FIG. 9 wherein the alternate connection of the pod cover to the second sheet illustrated in FIG. 8 is employed. Components of this embodiment are given the same reference numerals as the similar components in the preferred embodiment with the prefix "2". In this embodiment, the lateral edges 219 of the second sheet 218 and the spacer rails 230 extend beyond the edge 217 of the second sheet, along the lateral edges of the container 214 toward the leading edge of the film unit. With this arrangement the transition of the seal of the pod cover 234 at the lateral edges of the leading edge of the second sheet is moved away from a region contacted by the processing composition, thereby reducing the possibility of leakage at that point.

Still another embodiment of the present invention is one in which the intermediate sheet is utilized in film units employing a photographic system similar to that disclosed and described in U.S. Pat. No. 3,415,644. In this construction, the photographic layers are applied to the support sheets so that the film unit may be exposed and viewed from the same surface. However, with the use of the present invention of the intermediate coupling sheet, the same objects and advantages may be realized.

It will thus be seen that the present invention provides a novel and unique film unit construction utilizing a dual thickness opaque intermediate sheet which provides the necessary spacing between the outer sheets to provide the requisite processing composition thickness as well as providing a thinner mask portion which determines the perimeter of the image area. The mask portion assures that the border around the image is clear, attractive and uniform, and the fact that the processing composition can flow behind the mask portion to the spacer rail portions prevents any unsightly appearance which might otherwise occur along the image boundary. At the same time, the film unit is sealed together so as to prevent any escape of the processing composition. Further, the present invention permits satisfactory spreading of the processing composition without requiring the embossing of either the first or second sheets or the use of notched or recessed pressure members.

Still further, the present invention provides a processed film unit in which the first sheet is the only sheet visible from the viewing surface, with all other portions of the film unit being contained within the perimeter of that sheet. Also, the present invention provides a film unit with a planar viewing surface without a framing member which can detract from the appearance thereof. More significantly, the present invention provides a film unit which can be manufactured simply and economically.

The invention has been described in detail with particular reference to a preferred embodiment thereof, but it will be understood that variations and modifications can be effected within the spirit and scope of the invention.

We claim:

1. In a photographic film unit having lateral and transverse edges comprising a first sheet having thereon a layer of photosensitive material capable of recording an image when exposed to actinic radiation, a second sheet arranged in superposition with said first sheet with said photosensitive layer located between said sheets, and a container carrying a quantity of a fluent processing composition, said container having a discharge passage adapted to be opened in response to generation of pressure within said composition to discharge said composition from said container to between the sheets, the improvement comprising:

an intermediate sheet disposed between said first and second sheets and coupled to both of them at the lateral marginal portions thereof and separating said lateral marginal portions by a predetermined amount; and said intermediate sheet having an end portion extending from between said first and second sheets at one end thereof and being folded around that end of one of said first and second sheets to overlie the outside surface thereof, said end portion of said intermediate sheet being coupled to the outside surface of said one sheet to form a fluid receiving reservoir between said folded around portion of said intermediate sheet and said outside surface of said one sheet.

2. The film unit according to claim 1 wherein said lateral marginal portions of said intermediate sheet have an outer edge portion of a first predetermined thickness which is connected to the inner surfaces of both said first and second sheets and an inner edge portion of a second thickness less than said first thickness which is connected to only one of said sheets.

3. The film unit according to claim 2 wherein said intermediate sheet is a unitary element.

4. The film unit according to claim 3 wherein said intermediate sheet is formed of paper.

5. The film unit according to claim 4 wherein said intermediate sheet is formed of impregnated paper.

6. The film unit according to claim 3 wherein said intermediate sheet is formed of a polymeric sheet.

7. The film unit according to claim 3 wherein said unitary element is a laminate.

8. The film unit according to claim 7 wherein said laminate is formed of paper and a polymeric sheet.

9. The film unit according to claim 7 wherein said laminate is formed of a sheet member and a portion is formed of an applied material.

10. The film unit according to claim 7 wherein said laminate is formed of a polymeric sheet and a layer of applied polymer.

11. The film unit according to claim 5 wherein said inner edge portion of said second thickness is formed by machining a portion of said sheet which is originally of said first predetermined thickness.

12. The film unit according to claim 6 wherein said inner edge portion of said second thickness is formed by machining a portion of said sheet which is originally of said first predetermined thickness.

13. The film unit according to claim 7 wherein said inner edge portion of said second thickness is formed by machining a portion of said sheet which is originally of said first predetermined thickness.

14. The film unit according to claim 8 wherein said inner edge portion of said second thickness is formed by machining a portion of said sheet which is originally of said first predetermined thickness.

15. In a photographic film unit having lateral and transverse edges comprising a first generally rectangular sheet having thereon a layer of photosensitive material capable of recording an image when exposed to actinic radiation, a second generally rectangular sheet having at least its center portion transparent and arranged in super-position with said first sheet with said photosensitive layer located between said sheets, and a container carrying a quantity of a fluent processing composition, said container having a discharge passage adapted to be opened in response to generation of pressure within said composition to discharge said composition from said container to between the sheets, the improvement comprising:

an intermediate sheet disposed between said first and second sheets and coupled to both of them at the lateral marginal portions thereof and separating said lateral marginal portions by a predetermined amount;

said intermediate sheet extending from between the first and second sheets at one end thereof and being folded around that end of one of said first and second sheets to overlie and be connected to the outside surface thereof;

said intermediate sheet being formed with an exposure aperture substantially aligned with the transparent center portion of said second sheet; and the opposite end of said intermediate sheet being folded around said container and connected to the corresponding end of said one sheet.

16. The film unit according to claim 15 wherein said lateral margins of said intermediate sheet have an outer edge portion of a first predetermined thickness which is connected to the inner surfaces of both said first and second sheets and an inner edge portion of a second thickness less than said first thickness which is connected to only one of said sheets.

17. The film unit according to claim 15 wherein said intermediate sheet is formed of paper.

18. The film unit according to claim 15 wherein said intermediate sheet is formed of a polymeric sheet.

19. The film unit according to claim 16 wherein said portion of said second thickness is formed by machining a portion of said sheet which is originally of said first predetermined thickness.

20. In a photographic film unit having lateral and transverse edges comprising a first generally rectangular sheet having thereon a layer of photosensitive material capable of recording an image when exposed to actinic radiation, a second generally rectangular sheet having at least its center portion transparent and arranged in superposition with said first sheet with said photosensitive layer located between said sheets, and a container carrying a quantity of a viscous fluent processing composition, said container having a discharge passage adapted to be opened in response to generation of pressure within said composition to discharge said composition from said container to between the sheets, the improvement comprising:

a unitary intermediate sheet disposed between said first and second sheets and coupled to both of them at the lateral marginal portions thereof and separating said lateral marginal portions by a predetermined amount;

said intermediate sheet extending from between the first and second sheets at one end thereof and being folded around that end of one of said sheets to overlie and be connected to the outside surface thereof;

said intermediate sheet having lateral edges substantially in register with the lateral edges of said sheets and a centrally disposed exposure aperture having edges substantially aligned with the central transparent portion of said second sheet, the intermediate sheet being thicker at the lateral edges than at the boundary of the aperture; and means coupling said discharge passage of said container to said sheets at the other end of said one sheet and for conductin said liquid from said discharge passage to between said sheets at said other end, said coupling means including said intermediate sheet which is wrapped around said container and is connected to said other end of said one sheet.

21. The film unit according to claim 20 wherein the portion of said intermediate sheet which is wrapped around said container is connected to said one sheet between said sheets.

22. The film unit according to claim 20 wherein the portion of said intermediate sheet which is wrapped around said container is connected to the outside surface of said one sheet.

23. In a photographic film unit having lateral and transverse edged comprising a first generally rectangular sheet having thereon a layer of photosensitive material capable of recording an image when exposed to actinic radiation, a second generally rectangular sheet having at least a center transparent portion and arranged in superposition with said first sheet with said photosensitive layer located between said sheets, and a container carrying a quantity of a fluent processing composition, said container having a discharge passage adapted to be opened in response to generation of pressure within said composition to discharge said composition from said container to between the sheets, the improvement comprising:

a unitary polymeric intermediate sheet disposed between said first and second sheets and coupled to the inner surface of both of them at the lateral marginal portions thereof and separating said lateral marginal portions by a predetermined amount;

said second sheet being shorter than said first sheet and being arranged with one end substantially superposed with the corresponding end of the first sheet;

said intermediate sheet having a first end portion extending from between the first and second sheets at said superposed end thereof and being folded around that end of said second sheet to overlie the outside surface thereof, said first end portion of said intermediate sheet being coupled to the outside surface of said second sheet to form a trap between said folded around portion of said intermediate sheet and said outside surface of said second sheet to receive excess processing composition;

said intermediate sheet having lateral edges substantially in register with the lateral edges of said first and second sheets and a centrally disposed exposure aperture having edges substantially aligned with the central transparent portion of said second sheet, the intermediate sheet being thicker at the lateral edges than at the boundary of the aperture, the boundary of said aperture being coupled only to the inner surface of said first sheet; and means including a second end portion of said intermediate sheet for coupling said container to the portion of said first sheet extending beyond the end of said second sheet with the discharge passage of said container adjacent that end of said second sheet, said second end portion of said intermediate sheet being wrapped around said container and connected to said second sheet between the sheets for conducting said composition from said discharge passage of said container to between said sheets.

24. In an unprocessed self-processing photographic film unit comprising a photosensitive sheet; a second sheet in superimposed relationship with said photosensitive sheet; spacer means between said photosensitive sheet and said second sheet peripherally spacing said sheets and permanently securing said sheets together along opposed lateral edges thereof; and a container carrying a quantity of a fluent processing composition, said container having a discharge passage adapted to be opened in response to generation of pressure within said composition to discharge said composition from said container to between the sheets; the improvement comprising:

said spacer means extending from between said sheets at one end thereof and being secured transversely to one of said sheets adjacent said one end, said spacer means being completely within the compass of said one sheet at said one end, being folded away from said one sheet cover itself and being secured in the folded state to define a compartment for a fluent processing composition.

* * * * *